US008021063B2

(12) United States Patent
Hatano et al.

(10) Patent No.: US 8,021,063 B2
(45) Date of Patent: Sep. 20, 2011

(54) PRINTER WITH STAGGERED TRANSPORTING BELTS

(75) Inventors: Tomoki Hatano, Higashiomi (JP); Osamu Shinkawa, Chino (JP); Yusuke Sakagami, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 808 days.

(21) Appl. No.: 12/047,657

(22) Filed: Mar. 13, 2008

(65) Prior Publication Data

US 2008/0226377 A1 Sep. 18, 2008

(30) Foreign Application Priority Data

Mar. 15, 2007 (JP) ..... 2007-066818

(51) Int. Cl.
*B41J 13/08* (2006.01)
*B41J 2/01* (2006.01)
*B65H 5/02* (2006.01)

(52) U.S. Cl. ..... 400/635; 347/104

(58) Field of Classification Search ..... 400/629, 400/635; 198/817, 600, 461.1
See application file for complete search history.

(56) References Cited

U.S. PATENT DOCUMENTS 1,841,714 A * 1/1932 Cone ..... 198/606
3,902,589 A * 9/1975 Bylsma ..... 198/790
5,723,824 A * 3/1998 Stadler ..... 177/145
6,145,653 A * 11/2000 Mensch ..... 198/839
6,471,045 B1 * 10/2002 Harden ..... 198/817
2005/0046667 A1 3/2005 Ando et al.
2005/0206708 A1 9/2005 Yoda

FOREIGN PATENT DOCUMENTS

JP 08231074 A * 9/1996
JP 2005-075475 3/2005
JP 2005-104634 4/2005
WO 03080490 A3 10/2003

* cited by examiner

*Primary Examiner* — Daniel J Colilla

(74) *Attorney, Agent, or Firm* — Workman Nydegger

(57) ABSTRACT

A printer includes first transporting belts disposed in parallel at predetermined intervals in the direction intersecting the direction of transportation of print media. The first transporting belts transport a print medium while adsorbing the print medium. Second transporting belts disposed in parallel at predetermined intervals in the direction intersecting the direction of transportation of print media further transport the print media. The second transporting belts are separated from the first transporting belts at the downstream part of the first transporting belts in the direction of transportation of print media. A print head prints on the print medium. The position of separation at which the print medium is separated from the first transporting belts is different in the direction of transportation of print media between one of the first transporting belts and another one of the first transporting belts.

4 Claims, 4 Drawing Sheets

PRINTER WITH STAGGERED TRANSPORTING BELTS

BACKGROUND

1. Technical Field

The present invention relates to printers that print predetermined characters or images by ejecting, for example, fine liquid ink drops of multiple colors from multiple nozzles to form fine particles thereof (ink dots) onto a print medium.

2. Related Art

Such printers can easily provide low-cost high-quality color prints. Accordingly, they have come into wide use not only among office users but also among ordinary users with the widespread use of personal computers and digital cameras.

Such printers print predetermined characters or images onto a print medium to produce desired prints by discharging (ejecting) liquid ink drops from the nozzles of their print head (also referred to as a liquid ejection head) to form fine ink dots onto the print medium while relatively moving the print medium and the liquid ejection head. Among them, printers that move a liquid ejection head placed on a moving body, called a carriage, in the direction intersecting the direction of transportation of print media are generally referred to as multipass printers. On the other hand, printers capable of so-called one-pass printing by a liquid ejection head that is long in the direction of transportation of print media (which may not be of an integral type) are generally referred to as line head printers.

Some of these printers perform printing by applying electrical charge to, for example, a transporting belt, transporting a substantially insulating print medium electrostatically adsorbed to the transporting belt, and ejecting ink drops from a liquid ejection head onto the print medium transported. Another printer transports a print medium adsorbed on a transporting belt by negative air pressure. Such print-medium transporting methods are useful particularly for line head printers. The printer described in JP-A-2005-75475 has: two line-head liquid ejection heads at the upstream and downstream portions of the transportation of print media; and two sets of transporting units corresponding to the liquid ejection heads in the direction of transportation of print media, the transporting units each having a plurality of transporting belts disposed at predetermined intervals in the direction intersecting the direction of transportation of print media. This printer performs printing by transporting a print medium that is electrostatically adsorbed on the transporting belts, and ejecting ink drops onto the transported print medium from the upstream and downstream liquid ejection heads. The liquid ejection heads are disposed between the transporting belts. The troubles of the nozzles of the liquid ejection heads are resolved using a cleaning unit disposed directly under the liquid ejection heads, in other words, the nozzles are cleaned.

With such printers in which transporting units each having a plurality of transporting belts are disposed in the direction of transportation of print media, as disclosed in JP-A-2005-75475, a print medium on the transporting belts of the transporting unit upstream in the direction of transportation of print media (hereinafter, simply referred to as an upstream transporting unit) is moved at one point or substantially at one point (linearly as viewed from the top of the print medium) to the transporting belts of the transporting unit downstream in the direction of transportation of print media (hereinafter, simply referred to as a downstream transporting unit) as viewed from the cross direction of the transporting belts. That is, the rear end of the print medium in the direction of transportation (hereinafter, simply referred to as the rear end of the print medium) is separated from the transporting belts of the upstream transporting unit at the same time or substantially at the same time. With the line head printers, for which high-speed printing is required, the rear end of the print medium is separated from the transporting belts of the upstream transporting unit in an instant. This instant separation of the rear end of the print medium from the transporting belts of the upstream transporting unit may cause vibrations to thereby distort images printed on the print medium transported by the downstream transporting unit, resulting in the possibility of a decrease in image quality.

SUMMARY

An advantage of some aspects of the invention is to provide a printer in which high-quality images can be printed on a print medium transported by the downstream transporting unit.

A printer according to an aspect of the invention includes: a plurality of first transporting belts disposed in parallel at predetermined intervals in the direction intersecting the direction of transportation of print media, the first transporting belts transporting a print medium while adsorbing the print medium; a plurality of second transporting belts disposed in parallel at predetermined intervals in the direction intersecting the direction of transportation of print media, the second transporting belts further transporting the print medium separated from the first transporting belts, at the downstream part of the first transporting belts in the direction of transportation of print media; and a print head that prints on the print medium transported by the first transporting belts and the second transporting belts. The position of separation at which the print medium is separated from the plurality of first transporting belts is different in the direction of transportation of print media between one of the first transporting belts and another one of the first transporting belts.

This structure increases the number of separations of the rear end of the print medium in the direction of transportation from the plurality of transporting belts of the upstream transporting unit to disperse vibrations due to separation, which allows high-quality images to be printed on the print medium which is transported by the downstream transporting unit.

It is preferable that the one of the first transporting belts and the another one of the first transporting belts be different in length in the direction of transportation of print media.

It is preferable that the plurality of first transporting belts increase in length gradually in the direction of transportation of print media from the ends to the center in the direction intersecting the direction of transportation of print media.

This structure increases the number of separations of the rear end of the print medium from the plurality of transporting belts of the upstream transporting unit to thereby disperse vibrations due to separation, which further allows high-quality images to be printed on the print medium which is transported by the downstream transporting unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

A printer according to a first embodiment of the invention will be described with reference to the drawings.

Figure 1A:
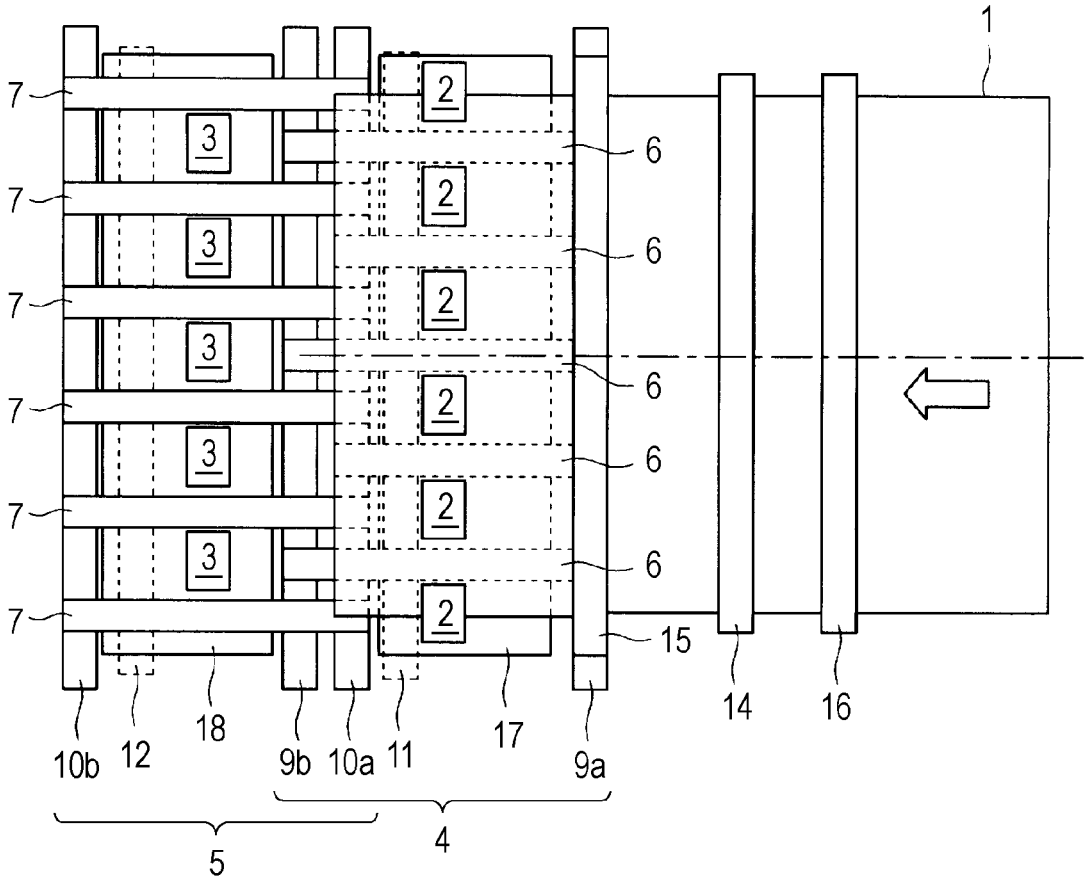
FIG. 1A is a schematic plan view of a printer according to a first embodiment of the invention.
Figure 1B:
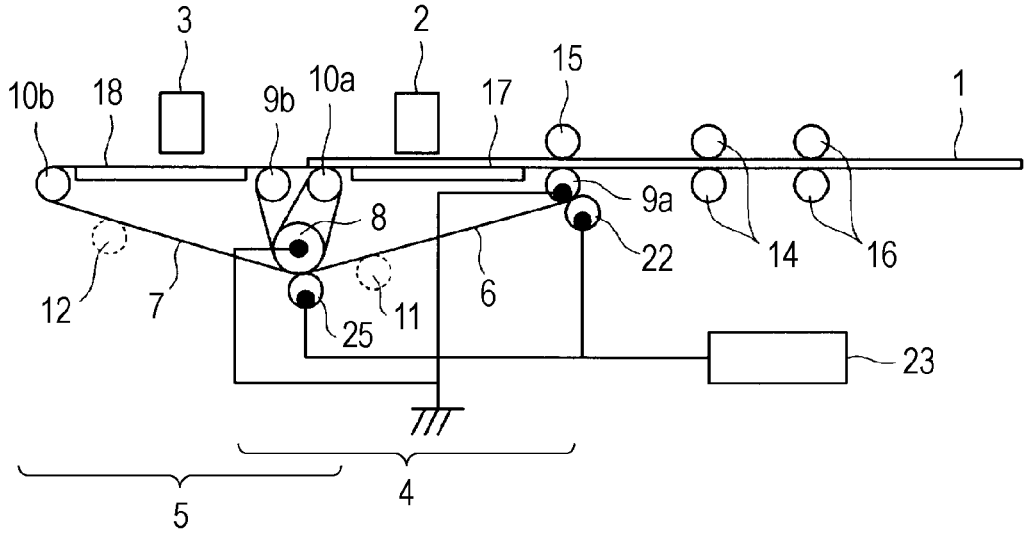
FIG. 1B is a side view of the printer.

FIGS. 1A and 1B are schematic diagrams of the printer of this embodiment: FIG. 1A is a plan view thereof; and FIG. 1B is a side view thereof. The printer shown in FIGS. 1A and 1B is a line head printer in which a print medium 1 is transported from the right to the left along the arrow, and is printed in a printing region midway through transportation. This embodiment has the liquid ejection head not only at one place but at two places.

Reference numeral 2 denotes a first liquid ejection head disposed upstream in the direction of transportation of the print medium 1, and reference numeral 3 denotes a second liquid ejection head disposed downstream of the transportation. Below the first liquid ejection head 2, a first transporting section 4 for transporting the print medium 1 is disposed. Below the second liquid ejection head 3, a second transporting section 5 is disposed. The first transporting section 4 includes five first transporting belts 6 disposed at predetermined intervals in the direction intersecting the direction of transportation of the print medium 1 (hereinafter, also referred to as the direction of the nozzle train). Likewise, the second transporting section 5 includes six second transporting belts 7 disposed at predetermined intervals in the direction intersecting the direction of transportation of the print medium 1 (in the direction of the nozzle train). This embodiment has an overlapping section in which the first transporting belts 6 of the first transporting section 4 and the second transporting belts 7 of the second transporting section 5 overlap. Both of the first transporting belts 6 and the second transporting belts 7 are single-layer belts made of insulating resin such as PET, polyimide, or fluoroplastic or two-layer belts whose front layer that electrostatically adsorbs the print medium 1 is made of such insulating resin and whose back layer has a resistance of $10^{10}$ ohms per square or less, for example.

The five first transporting belts 6 and the six second transporting belts 7 are alternately disposed next to each other in a so-called staggered arrangement. The overlapping section between the first transporting section 4 and the second transporting section 5 has a driving roller 8 between the first liquid ejection head 2 and the second liquid ejection head 3 and below the print-medium transporting line (which indicates the level at which the print medium 1 is transported). An upstream first driven roller 9*a* is disposed upstream from the first liquid ejection head 2 in the direction of transportation of the print medium and directly under the print-medium transporting line. A downstream first driven roller 9*b* is disposed downstream from the driving roller 8 and upstream from the second liquid ejection head 3 in the direction of transportation of the print medium, and directly under the print-medium transporting line. An upstream second driven roller 10*a* is disposed upstream from the driving roller 8 and downstream from the first liquid ejection head 2 in the direction of transportation of the print medium, and directly under the print-medium transporting line. A downstream second driven roller 10*b* is disposed downstream from the second liquid ejection head 3 in the direction of transportation of the print medium and directly under the print-medium transporting line.

The six second transporting belts 7 which constitute the second transporting section 5 are wound around the driving roller 8, the upstream second driven roller 10*a*, and the downstream second driven roller 10*b*, while the five first transporting belts 6 which constitutes the first transporting section 4 are composed of ones that are wound around the driving roller 8, the upstream first driven roller 9*a*, and the downstream first driven roller 9*b* and ones that are wound around the driving roller 8, the upstream first driven roller 9*a*, and the upstream second driven roller 10*a* are disposed alternately. Specifically, the outermost two first transporting belts 6 and the central one first transporting belt 6 in the direction of the nozzle train are wound around the driving roller 8, the upstream first driven roller 9*a* and the downstream first driven roller 9*b*, while the two first transporting belts 6 at the second from the outside in the direction of the nozzle train are wound around the driving roller 8, the upstream first driven roller 9*a*, and the upstream second driven roller 10*a*. In other words, the first transporting belts 6 of the first transporting section 4, which is the upstream transporting unit, are alternately long and short, which constitute the print-medium separating region of the invention.

The driving roller 8 is connected to an electric motor (not shown). Accordingly, when the driving roller 8 is rotated by the electric motor, the first transporting section 4 constituted by the first transporting belts 6 and the second transporting section 5 constituted by the second transporting belts 7 are moved in synchronism at the same speed. The upstream first driven roller 9*a* and the driving roller 8 are grounded, because the first transporting belts 6 and the second transporting belts 7 are charged by a first charging roller 22 and a second charging roller 25, to be described later, respectively.

The first liquid ejection heads 2 and the second liquid ejection heads 3 are shifted in the direction of transportation of the print medium 1 for each color, for example, four colors of yellow (Y), magenta (M), cyan (C) and black (K). The liquid ejection heads 2 and 3 are supplied with inks from ink tanks of the respective colors (not shown) through ink feed tubes. The liquid ejection heads 2 and 3 each have multiple nozzles in the direction intersecting the direction of transportation of the print medium 1 (that is, in the direction of the nozzle train) from which a necessary amount of ink drops is ejected onto necessary portions at the same time to form fine ink dots on the print medium 1. This is executed for each color so that a so-called one-pass printing can be carried out only by passing the print medium 1 transported by the first transporting section 4 and the second transporting section 5 one time. That is, the region where the liquid ejection heads 2 and 3 are disposed corresponds to the printing region.

Examples of methods for discharging ink from the nozzles of the liquid ejection heads include an electrostatic method, a piezoelectric method, and a film-boiling ink jet method. The electrostatic method is one with which if an electrostatic gap serving as an actuator is given a driving signal, the diaphragm in the cavity is displaced to change the pressure in the cavity, so that ink drops are discharged from the nozzles. The piezoelectric method is one with which if a piezoelectric element serving as an actuator is given a driving signal, the diaphragm in the cavity is displaced to change the pressure in the cavity, so that ink drops are discharged from the nozzles. The film-boiling ink jet method is one with which a small heater is provided in the cavity, which heats ink instantly to 300° C. or more to cause film boiling to generate bubbles, which causes changes in pressure, so that ink drops are discharged from the nozzles. While the invention can be applied to any of the ink discharge methods, it is particularly suitable for piezoelectric elements that can control the discharge amount of ink drops by controlling the peak value or the rise and fall of the voltage of the driving signal.

The first liquid ejection heads 2 are provided only between the five first transporting belts 6 and on both ends of the first transporting section 4. The second liquid ejection heads 3 are provided only between the six second transporting belts 7 of the second transporting section 5. This is for the purpose of cleaning the liquid ejection heads 2 and 3 with cleaning sections, to be described later. However, this arrangement precludes one-pass full-page printing only with one of the liquid ejection heads 2 and 3. Accordingly, the first liquid ejection heads 2 and the second liquid ejection heads 3 are shifted in the direction of transportation of the print medium 1 to make up for their unprintable areas. All the nozzles have their independent actuators, each having a selection switch.

Below the first liquid ejection heads 2, first cleaning caps (not shown) for cleaning the first liquid ejection heads 2 are disposed. Below the second liquid ejection heads 3, second cleaning caps (not shown) for cleaning the second liquid ejection heads 3 are disposed. Each of the cleaning caps has such a size as to pass between the five first transporting belts 6 of the first transporting section 4 and between the six second transporting belts 7 of the second transporting section 5. These cleaning caps each include a cap body with a rectangular bottom that can cover the nozzles in the lower surface, that is, the nozzle surface of the liquid ejection heads 2 and 3 and can come into close contact with the nozzle surface, an ink absorber disposed on the bottom, a tube pump connected to the bottom of the cap body, and an elevator that moves the cap body up and down.

The cleaning caps are moved upward by the elevators into close contact with the nozzle surfaces of the liquid ejection heads 2 and 3, and in that state, the interior of the caps is brought to negative pressure by the tube pumps. Then, ink drops and bubbles are sucked from the nozzles open in the nozzle surfaces of the liquid ejection heads 2 and 3, so that the liquid ejection heads 2 and 3 are cleaned. After completion of the cleaning, the cleaning caps are moved downward. Alternatively, the nozzle surfaces may be wiped by wipers so that the menisci on the nozzles are smoothed. In the case where ink drops are ejected without the print medium 1 to recover or maintain the nozzles in the normal state, that is, for so-called flushing, the cleaning caps may not be brought into close contact with the nozzle surfaces of the liquid ejection heads 2 and 3.

A pair of gate rollers 14 for controlling the timing to feed the print medium 1 fed from a paper feed section and for correcting the skew of the print medium 1 is provided upstream from the upstream first driven roller 9*a* in such a manner as to nip the print-medium transport line. The skew is the distortion of the print medium 1 with respect to the direction of transportation. A pair of feed rollers 16 for feeding the print medium 1 is provided upstream from the gate rollers 14 in such a manner as to nip the print-medium transport line. Reference numeral 15 in the drawings denotes a pressure roller that pushes the print medium 1 against the upstream first driven roller 9*a* to allow the print medium 1 to be electrostatically adsorbed on the first transporting belts 6.

In this embodiment, a first belt cleaning roller 11 is disposed under the first transporting belts 6, and a second belt cleaning roller 12 is disposed under the second transporting belts 7. These belt cleaning rollers 11 and 12 are made of sponge such as urethane foam that easily absorbs ink.

A first flatness controller 17 that controls the flatness of the print medium 1 is provided under the printing region of the first liquid ejection heads 2. A second flatness controller 18 is provided under the printing region of the second liquid ejection heads 3. These flatness controllers 17 and 18 are generally called platens, which support the tracks of the transporting belts 6 and 7 from below to control the flatness of the print medium 1 that is electrostatically adsorbed thereto.

The first charging roller 22 serving as charging means for charging the first transporting belts 6 is disposed under the upstream first driven roller 9*a*. The first charging roller 22 is in contact with the first transporting belts 6 to hold them between it and the upstream first driven roller 9*a*. A second charging roller 25 serving as charging means for charging the second transporting belts 7 is disposed under the driving roller 8. The second charging roller 25 is in contact with the second transporting belts 7 to hold them between it and the driving roller 8. Both the first charging roller 22 and the second charging roller 25 are connected to a power supply 23 and are given positive and negative electric charges alternately by an alternating voltage of about a few kVp-p. Such belts are generally made of a middle- or high-resistance material or an insulating material. When the surfaces (outer surfaces) of the first transporting belts 6 and the second transporting belts 7 are alternately charged in opposite polarities by a belt charging unit, the electric field generated between the adjacent polarities, that is, the electrostatic force acts as adsorbing power to adsorb the print medium 1. In addition to the alternating voltage, direct voltage may be used to charge the transporting belts 6 and 7. In this case, the potential of the transporting belts 6 and 7 causes dielectric polarization in the print medium 1, so that a potential difference is generated between the polarized print medium 1 and the transporting belts 6 and 7. This potential difference acts as adsorbing power to cause the print medium 1 to be adsorbed on the surfaces of the first transporting belts 6 and the second transporting belts 7.

In this way, this printer operates in such a manner that the surfaces of the first transporting belts 6 are charged by the first charging roller 22, and the surfaces of the second transporting belts 7 are charged by the second charging roller 25, in which state the print medium 1 is fed through the gate rollers 14; when the print medium 1 is pushed against the first transporting belts 6 by the pressure roller 15, the print medium 1 is electrostatically adsorbed on the surfaces of the first transporting belts 6 by the adsorbing power due to the electric field, in which state the driving roller 8 is rotated by the electric motor; its rotating force is transmitted to the upstream first driven roller 9*a* and the downstream first driven roller 9*b* through the first transporting belts 6.

The first transporting belts 6 are thus moved downstream in the direction of transportation to move the print medium 1 to below the first liquid ejection heads 2, with the print medium 1 electrostatically adsorbed thereto, and ink drops are ejected from the nozzles of the first liquid ejection heads 2 to perform printing. After completion of the printing by the first liquid ejection heads 2, the print medium 1 is moved downstream in the direction of transportation and transferred onto the second transporting belts 7 of the second transporting section 5. As described above, the surfaces of the second transporting belts 7 are also charged by the second charging roller 25, so that the print medium 1 is electrostatically adsorbed on the surfaces of the second transporting belts 7 by the adsorbing power due to the electric field, described above.

In this state, the second transporting belts 7 are moved downstream in the direction of transportation to move the print medium 1 to below the second liquid ejection heads 3, and the ink drops are ejected from the nozzles of the second liquid ejection heads 3 to perform printing. After completion of the printing by the second liquid ejection heads 3, the print medium 1 is further moved downstream in the direction of transportation, and ejected onto an output section while being separated from the outer surfaces of the second transporting belts 7 by a separating unit (not shown).

When the first and second liquid ejection heads 2 and 3 need cleaning, the first and second cleaning caps 12 and 13 are moved upward so that the cap bodies are brought into close contact with the nozzle surfaces of the first and second liquid ejection heads 2 and 3, in which state the interior of the caps 12 and 13 are brought to negative pressure, so that ink drops and bubbles are absorbed through the nozzles of the first and second liquid ejection heads 2 and 3 to clean them, and thereafter the first and second cleaning caps 12 and 13 are moved downward.

In this embodiment, the first transporting belts 6 of the first transporting section 4 upstream in the direction of transportation of print media is alternately long and short in the overlapping portion between the first transporting section 4 and the second transporting section 5. As described above, this embodiment is configured such that the print medium 1 that is electrostatically adsorbed on the five first transporting belts 6 of the first transporting section 4 is transferred onto the six second transporting belts 7 of the second transporting section 5 while being electrostatically adsorbed thereto. These alternate long and short first transporting belts 6 of the first transporting section 4 upstream in the direction of transportation of print media cause the print medium 1 to be separated at two positions in the direction of transportation of print media from the first transporting belts 6. As a result, vibrations due to separation are dispersed to two times, which allows high-quality images to be printed on the print medium 1 which is transported while being electrostatically adsorbed on the second transporting belts 7 of the second transporting section 5. That is, the overlapping portion between the first transporting section 4 and the second transporting section 5 corresponds to the print-medium separating region of the invention. Moreover, in this embodiment, the center of the transporting force of the first transporting section 4 and the center of the transporting force of the second transporting section 5 agree with each other. Accordingly, no turning moment is applied to the print medium 1 when the print medium 1 is transferred from the first transporting section 4 onto the second transporting section 5, allowing the position of the print medium 1 to be held correctly.

The printer of this embodiment has print-medium separating regions at two or more positions in the direction of transportation of print media, in which the print medium 1 is separated from the first transporting belts 6 of the first transporting section (upstream transporting unit) 4, as described above. This increases the number of separations of the rear end of the print medium 1 from the first transporting belts 6 of the first transporting section 4, which disperses vibrations due to separation, thus allowing high-quality images to be printed on the print medium 1 which is transported by the second transporting section (downstream transporting unit) 5.

Moreover, the first transporting belts 6 of the first transporting section 4 are alternately long and short in the direction of transportation of print media. This structure increases the number of separations of the rear end of the print medium 1 from the first transporting belts 6 of the first transporting section 4 to two times, which disperses vibrations due to separation, thus allowing high-quality images to be printed on the print medium 1 which is transported by the second transporting section 5.

Figure 2:
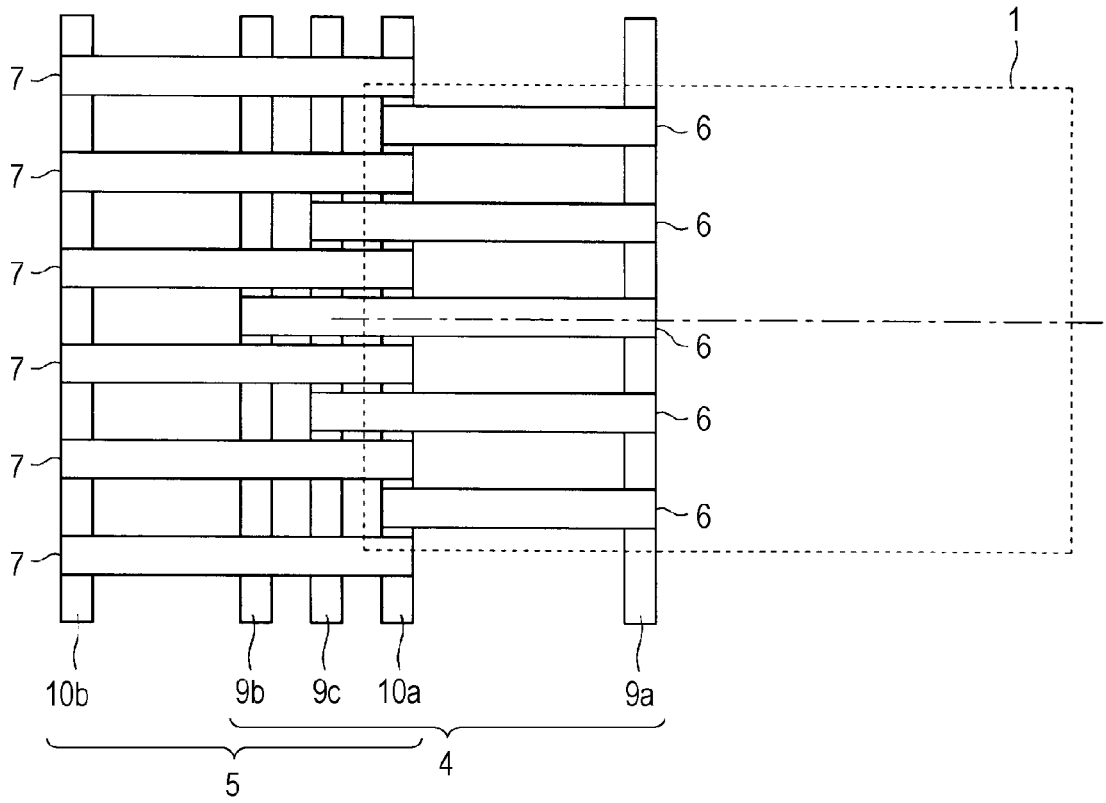
FIG. 2 is a schematic plan view of a printer according to a second embodiment of the invention.

Referring next to FIG. 2, a printer according to a second embodiment of the invention will be described. FIG. 2 shows only the first transporting section 4 and the second transporting section 5 extracted from the printer of this embodiment. The other components are the same as those of the first embodiment shown in FIGS. 1A and 1B.

This embodiment has another roller, a downstream first auxiliary driven roller 9*c*, between the downstream first driven roller 9*b* and the upstream second driven roller 10*a*, that is, upstream from the downstream first driven roller 9*b* in the direction of transportation of print media. The first transporting belts 6 at the uppermost and lowermost positions in FIG. 2, that is, on both ends in the direction intersecting the direction of transportation of print media are wound around the upstream first driven roller 9*a*, the upstream second driven roller 10*a*, and a driving roller (not shown). The first transporting belts 6 inside by one, that is, at the second from both ends in the direction intersecting the direction of transportation of print media are wound around the upstream first driven roller 9*a*, the downstream first auxiliary driven roller 9*c*, and the driving roller (not shown). The first transporting belt 6 in the center of FIG. 2, that is, in the center in the direction intersecting the direction of transportation of print media is wound around the upstream first driven roller 9*a*, the downstream first driven roller 9*b*, and the driving roller (not shown). That is, the lengths of the five first transporting belts 6 of the first transporting section 4 in the direction of transportation of print media gradually increase from the ends to the center in the direction intersecting the direction of transportation of print media.

As in the first embodiment, this embodiment is also configured such that the print medium 1 which is electrostatically adsorbed on the five first transporting belts 6 of the first transporting section 4 are transferred onto the six second transporting belts 7 of the second transporting section 5 while being electrostatically adsorbed thereto. With this structure in which the lengths of the five first transporting belts 6 of the first transporting section 4 gradually increase from the ends to the center in the direction intersecting the direction of transportation of print media, the print medium 1 is separated at three positions in the direction of transportation of print media from the first transporting belts 6. As a result, vibrations due to separation is dispersed to three times, which allows high-quality images to be printed on the print medium 1 which is transported while being electrostatically adsorbed on the second transporting belts 7 of the second transporting section 5. Also in this embodiment, the center of the transporting force of the first transporting section 4 and the center of the transporting force of the second transporting section 5 agree with each other. Accordingly, no turning moment is applied to the print medium 1 when the print medium 1 is transferred from the first transporting section 4 onto the second transporting section 5, allowing the position of the print medium 1 to be held correctly.

As described above, the printer of this embodiment has another advantage in addition to that of the first embodiment, because it has a structure in which the lengths of the plurality of first transporting belts 6 of the first transporting section (upstream transporting unit) 4 gradually increase from the ends to the center in the direction intersecting the direction of transportation of print media. This increases the number of separations of the rear end of the print medium 1 from the first transporting belts 6 of the first transporting section (upstream transporting unit) 4 to three times or more to disperse vibrations due to separation, which allows high-quality images to be printed on the print medium 1 which is transported by the second transporting section (downstream transporting unit) 5.

Figure 3A:
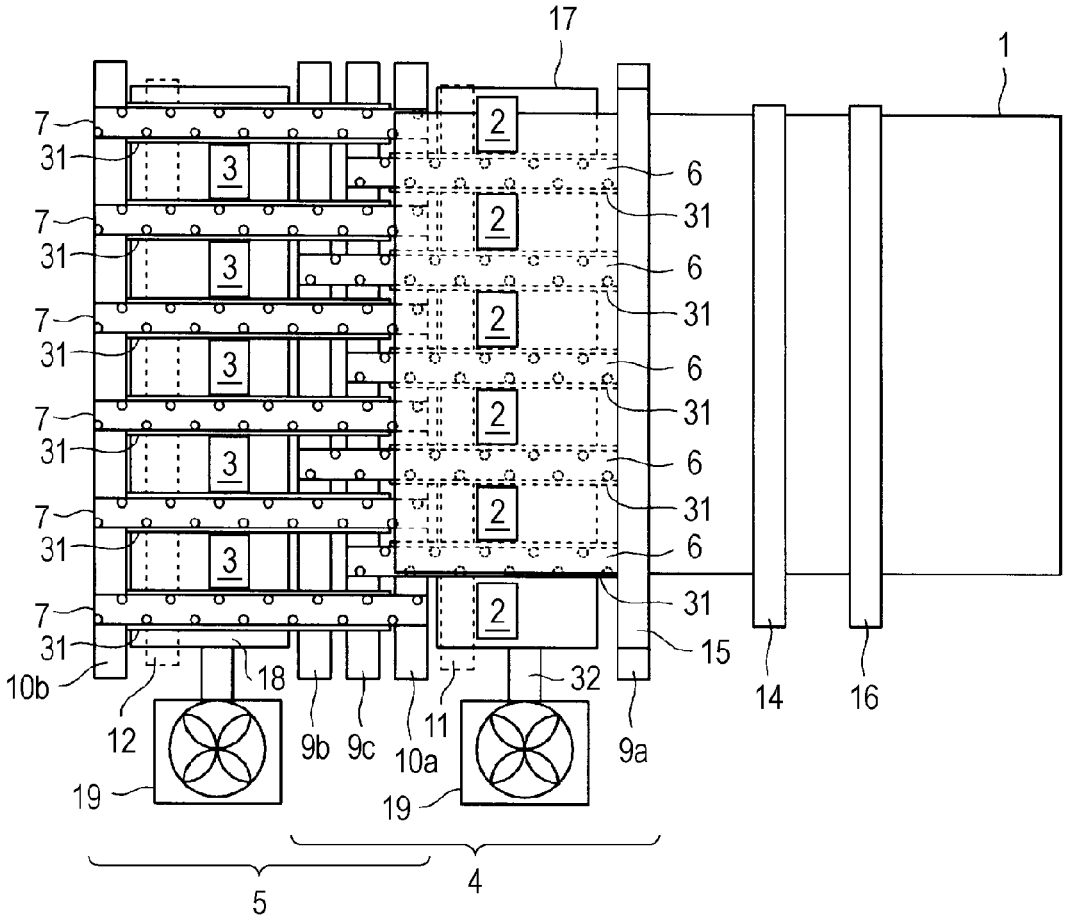
FIG. 3A is a schematic plan view of a printer according to a third embodiment of the invention.
Figure 3B:
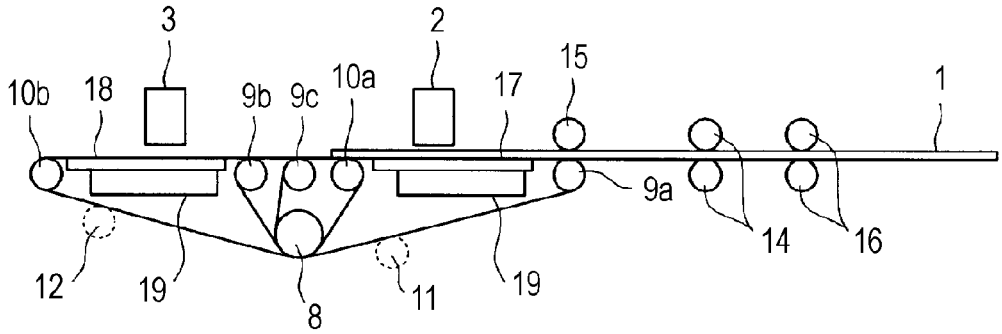
FIG. 3B is a side view of the printer.

Referring next to FIGS. 3A and 3B, a printer according to a third embodiment of the invention will be described. As in the second embodiment of FIG. 2, this embodiment has another roller, the downstream first auxiliary driven roller 9*c*, between the downstream first driven roller 9*b* and the upstream second driven roller 10*a*, that is, upstream from the downstream first driven roller 9*b* in the direction of transportation of print media. However, the second transporting belts 7 of the second transporting section 5 are wound around the upstream second driven roller 10*a*, the downstream second driven roller 10*b*, and the driving roller 8, while the first transporting belts 6 of the first transporting section 4 are alternately wound around the downstream first driven roller 9*b* and the downstream first auxiliary driven roller 9*c*. Specifically, the uppermost, the central, and the lowermost first transporting belts 6 are wound around the upstream first driven roller 9*a*, the downstream first auxiliary driven roller 9*c*, and the driving roller 8, and the first transporting belts 6 at the second from the top and at the second from the bottom are wound around the upstream first driven roller 9*a*, the downstream first driven roller 9*b*, and the driving roller 8. Accordingly, the first transporting belts 6 of the first transporting section 4 are alternately long and short in the direction of transportation of print media, as in the first embodiment.

Figure 4:
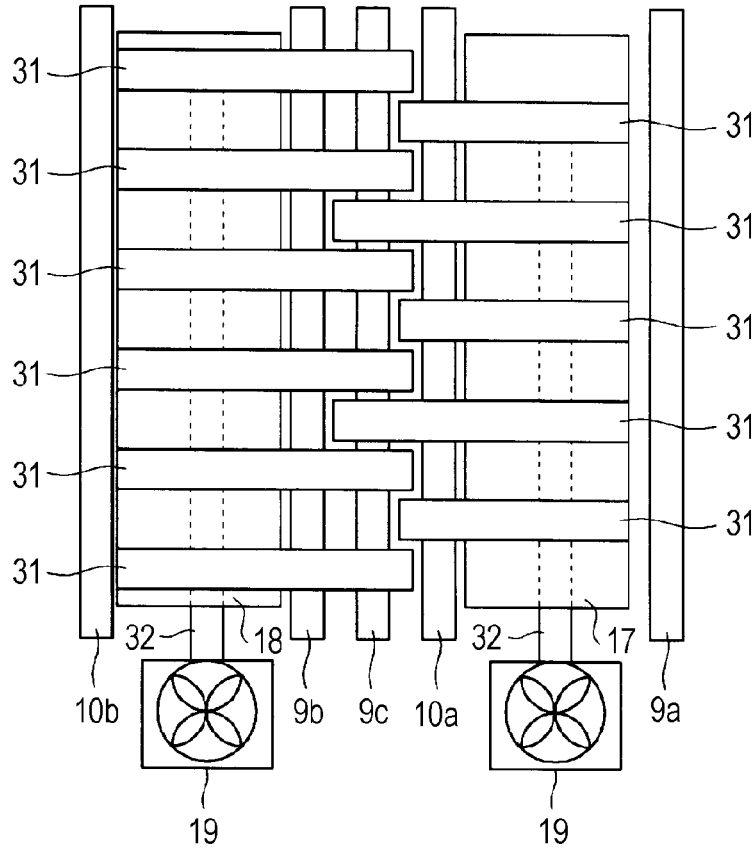
FIG. 4 is an explanatory diagram of the printer shown in FIG. 3A, with the exception of the transporting belts.
Figure 5:
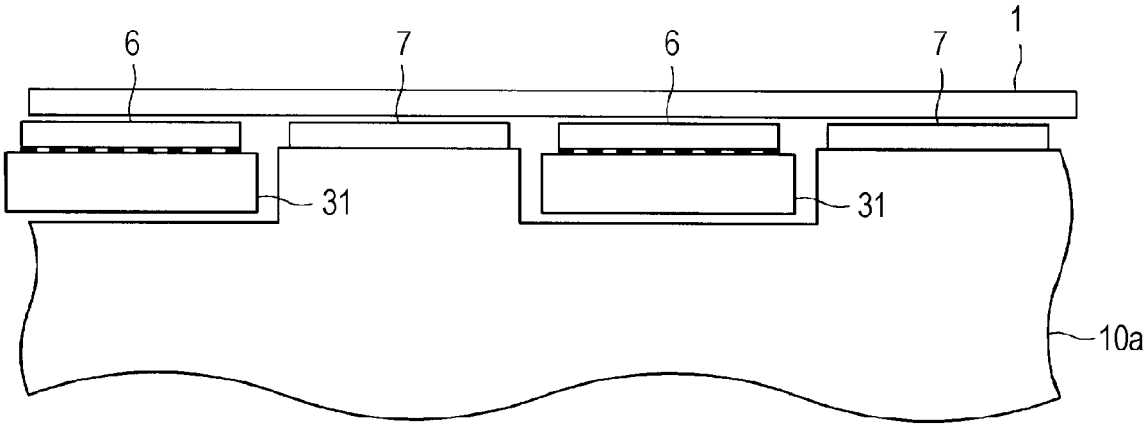
FIG. 5 is an explanatory diagram of the tie-in point between a driven roller and ducts of the printer shown in FIGS. 3A and 3B.

This embodiment is fundamentally different from the first and second embodiments in the method for adsorbing print media onto the transporting belts. Both of the transporting belts 6 and 7 of this embodiment have a lot of small openings for sucking air. FIG. 4 is a plan view of the printer shown in FIG. 3A, with the exception of the transporting belts 6 and 7. Thin box-shaped ducts 31 having a mesh top surface are disposed directly under the print-medium transporting lines of the transporting belts 6 and 7. The ducts 31 pass through the flatness controllers 17 and 18 to communicate with a common duct 32. The common duct 32 is connected to a suction fan 19. FIG. 5 shows a cross section of the upstream second driven roller 10*a* and the ducts 31, which represents the tie-in point between the ducts 31 and the driven rollers 9*b* and 10*a*. As is clear from FIG. 5, the interaction region between the upstream second driven roller 10*a* and the ducts 31 cuts out the upstream second driven roller 10*a*.

Accordingly, the printer of this embodiment is configured such that when the air in the common duct 32 and the ducts 31 is sucked with the suction fan 19, the print medium 1 is adsorbed onto the transporting belts 6 and 7 by negative air pressure through the openings of the transporting belts 6 and 7. Since the embodiment is also configured such that the first transporting belts 6 of the first transporting section 4 upstream in the direction of transportation of print media are alternately long and short in the direction of transportation of print media. Accordingly, the print medium 1 is separated from the first transporting belts 6 at two positions in the direction of transportation of print media. As a result, vibrations due to separation is dispersed into two times, which allows high-quality images to be printed on the print medium 1 which is transported while being adsorbed on the second transporting belts 7 of the second transporting section 5 by negative air pressure.

Although the embodiments are described only for applications to a so-called line head printer, the printer of the invention can be applied to printers of every description, such as multipass printers, which adsorb print media by a plurality of transporting belts.

What is claimed is:

1. A printer comprising:

a plurality of first transporting belts disposed in parallel at predetermined intervals in a direction intersecting a direction of transportation of print media, the first transporting belts transporting a print medium while electrostatically attracting the print medium;

a plurality of second transporting belts disposed in parallel at predetermined intervals in the direction intersecting the direction of transportation of print media, the second transporting belts further transporting the print medium such that the print medium is separated from the first transporting belts, at the downstream part of the first transporting belts in the direction of transportation of print media; and a print head that prints on the print medium transported by the first transporting belts and the second transporting belts;

wherein a first position of separation at which the print medium is separated from a first belt of the plurality of first transporting belts is different in the direction of transportation of the print media than a second position of separation at which the print medium is separated from a second belt of the plurality of first transporting belts, wherein the first transporting belts and the second transporting belts are alternatively disposed next to each other and overlap with different lengths in the direction of transportation of the print media between adjoined belts.

2. The printer according to claim 1, wherein said first belt of the plurality of first transporting belts and said second belt of the plurality of first transporting belts are different in length in the direction of transportation of print media.

3. The printer according to claim 2, wherein the plurality of first transporting belts increase in length gradually in the direction of transportation of the print media from belts of the plurality of first transporting belts located on an outside edge of the plurality of first transporting belts toward belts of the plurality of first transporting belts located at a center of the plurality of first transporting belts in the direction intersecting the direction of transportation of print media.

4. The printer according to claim 1, wherein the print head is a liquid ejection head that ejects ink drops.

* * * * *